US005782255A

United States Patent [19]

Magnin et al.

[11] Patent Number: 5,782,255

[45] Date of Patent: Jul. 21, 1998

[54] METHOD AND DEVICE FOR CLEANING A TUBE PLATE OF A HEAT EXCHANGER FROM INSIDE THE BUNDLE OF THE HEAT EXCHANGER

[75] Inventors: Bernard Magnin, Saint Victor Sur Rhins; Alain Vouzelland, Fontaines sur Saone; Martin Bourdelet; Catherine Weber-Guevara, both of Lyons, all of France

[73] Assignee: Framatome, Courbevoie, France

[21] Appl. No.: 769,408

[22] Filed: Dec. 19, 1996

[30] Foreign Application Priority Data

Dec. 22, 1995 [FR] France ..... 95 15418

[51] Int. Cl.[6] ..... B08B 9/08

[52] U.S. Cl. ..... 134/167 R; 134/181; 122/392; 239/240; 239/263.3

[58] Field of Search ..... 134/167 C, 167 R, 134/198, 172, 181; 122/390, 392, 405; 239/237, 240, 263.3, 263.1

[56] References Cited

U.S. PATENT DOCUMENTS

| | | | |
|---|---|---|---|
| 2,355,571 | 8/1944 | Spears | 122/392 |
| 2,725,064 | 11/1955 | Tamminga | 134/167 R |
| 4,452,183 | 6/1984 | Yazidjian | 122/392 |
| 4,638,667 | 1/1987 | Zimmer et al. | 134/167 R |
| 4,676,201 | 6/1987 | Lahoda et al. | 122/392 |
| 4,887,555 | 12/1989 | Smet | 122/392 |
| 5,036,871 | 8/1991 | Rugieri et al. | 134/167 R |
| 5,194,217 | 3/1993 | St. Louis et al. | 134/167 R |
| 5,320,072 | 6/1994 | Theiss et al. | 134/167 R |
| 5,411,043 | 5/1995 | Lamler | 134/172 |
| 5,572,957 | 11/1996 | Vandenberg | 122/392 |
| 5,667,139 | 9/1997 | Dickie | 122/392 |

FOREIGN PATENT DOCUMENTS

| | | | |
|---|---|---|---|
| 0 077 255 | 4/1983 | European Pat. Off. . | |
| 0 307 961 | 3/1989 | European Pat. Off. . | |
| 0 459 597 A1 | 12/1991 | European Pat. Off. . | |
| 2 550 967 | 3/1985 | France . | |
| 650678 | 3/1979 | U.S.S.R. | 134/167 R |
| PCT/US95/00061 | 1/1995 | WIPO . | |

*Primary Examiner*—Frankie L. Stinson

*Attorney, Agent, or Firm*—Pollock, Vande Sande & Priddy

[57] ABSTRACT

At least two pivoting jets (**55*a*, 55*b*, 55*c***) of cleaning liquid, each directed between two successive lines of tubes substantially perpendicular to the rows of tubes, are sent, in succession, from locations situated inside the bundle of the steam generator, into a space between two successive rows of tubes so as to sweep the tube plate between a central part vertically in line with the space between the two rows of tubes and two outer parts situated at the periphery of the bundle and along the length of the space between the rows of tubes. The flow rate of cleaning liquid is at least equal to 20 l/min, per jet. The invention applies in particular to the cleaning of the tube plate of a steam generator of a pressurized-water nuclear reactor.

9 Claims, 10 Drawing Sheets

METHOD AND DEVICE FOR CLEANING A TUBE PLATE OF A HEAT EXCHANGER FROM INSIDE THE BUNDLE OF THE HEAT EXCHANGER

The invention relates to a method and to a device for cleaning a tube plate of a heat exchanger, particularly of a steam generator of a pressurized-water nuclear reactor, using liquid jets from inside the bundle.

Pressurized-water nuclear reactors include steam generators which heat up the feed water and turn it into steam using the heat transported by the pressurized water for cooling the core of the reactor. Pressurized-water reactors include, on each of their primary legs, a steam generator which has a primary part through which the pressurized water for cooling the reactor flows, and a secondary part receiving the feed water which is heated up and progressively turned into steam and reemerges from the secondary part of the steam generator in the form of steam which is sent to a turbine associated with the nuclear reactor in order to drive an alternator for producing electrical current.

Such steam generators include an outer barrel of cylindrical overall shape arranged with its axis vertical and integral with a substantially horizontal tube plate, the lower face or inlet face of which constitutes one wall of the water box for feeding the steam generator with pressurized water constituting the primary fluid.

The steam generator also includes a bundle of tubes bent into a U, each tube including two straight mutually parallel legs, the ends of which are fixed into holes passing through the tube plate between the lower inlet face of the tube plate and the upper outlet face via which the tubes of the bundle penetrate the secondary part of the steam generator which is delimited by an inner bundle wrapper arranged in a coaxial position inside the outer barrel of the steam generator, and delimiting an annular space with the outer barrel. The inner wrapper includes a lower end situated a certain distance above the upper face of the tube plate, so as to form a space for the passage of the water for feeding the steam generator which is introduced into the secondary part via the annular space.

The holes for the passage and fixing of the tubes of the bundle into the tube plate are arranged in a uniform lattice over the entire surface of the tube plate, except for the peripheral part of the tube plate which constitutes an annular free path vertically in line with the annular space for bringing in feed water and for a central part of diametral direction constituting a central alley or tube lane on either side of which the straight legs of the tubes are arranged. The tubes at the central part of the bundle delimit, between their straight legs, a free space extending in the axial direction of the tubes and of the bundle, above the central alley of the tube plate.

The tubes of the bundle are bent into a U and constitute a central part of substantially semicircular shape, the radius of curvature of which varies between a minimum value for the tubes situated at the central part of the bundle, the straight legs of which are to be found on either side of the tube lane and a maximum value for the tubes situated at the peripheral part of the bundle. The tubes of the bundle which are bent into a U are arranged in a plurality of mutually parallel flat rows, each including a set of tubes for which the radii of curvature vary between a minimum value and a maximum value. The rows of tubes which are perpendicular to the tube lane of the steam generator have a number of tubes which decreases from the central part of the bundle as far as the peripheral part, in the direction of the central tube lane.

The flat rows, each consisting of a set of tubes bent into a U for which the radii of curvature increase from the inner part as far as the outer part of the row, are separated from one another by spaces having a substantially constant width, it being possible for this width to be of the order of 10 mm.

During the operation of the steam generator, the pressurized water which constitutes the primary fluid for cooling the core is brought into a compartment of the water box so that it is distributed under the inlet face of the tube plate into the inlet ends of the tubes of the bundle. The high-temperature pressurized water then flows into the tubes of the bundle in order to reemerge through the outlet ends of these tubes in a second compartment of the water box connected to the primary circuit of the reactor in order to return the cooling water to the vessel.

The feed water which is brought in and distributed in the annular free space around the inner bundle wrapper flows from top to bottom in the annular free space, penetrates the bundle wrapper below its lower end then comes into contact with the tubes of the bundle through the wall of which heat exchange takes place between the primary fluid and the feed water. The feed water is progressively heated up then turned into steam as it travels in contact with the tubes of the bundle in the vertical direction from bottom to top.

The steam produced is dried in the upper part of the steam generator and leaves the outer barrel via a nozzle connected to the upper end of the outer barrel.

The steam produced which is used in the turbine of the reactor is condensed and collected at a condenser then sent back to the steam generator, so that the secondary part of the steam generator through which the feed water flows operates in closed circuit.

The feed water is treated and exhibits chemical properties which limit its corrosive power as far as possible. However, after a period of operation of the nuclear reactor, the feed water becomes laden with corrosive products such as oxides which tend to be deposited in the form of sludge in those parts of the secondary circuit where the feed water flows at low speed, and particularly over the upper outlet face of the tube plate of the steam generator between the tubes of the bundle. The sludge deposited on the tube plate at the junction between the tubes of the bundle and the tube plate produces a corrosive effect which may give rise, in time, to a decrease in the thickness of the tubes, to the formation of cracks in their wall, and possibly to breakage thereof.

In order to avoid these phenomena of corrosion, the tube plates of steam generators must be cleaned out regularly during the phases when the nuclear reactor is shut down for maintenance and refuelling, and even before commissioning.

This cleaning may be carried out by sending jets of water over the upper outlet face of the tube plate between the rows of tubes of the bundle in the direction going from the centre to the periphery of the bundle.

The sludge is detached from the outlet face of the tube plate and directed towards the peripheral free space situated around the lower part of the bundle on the upper face of the tube plate where it is sucked out, for example by pipework inserted through an opening passing through the outer barrel of the steam generator.

Such cleaning using liquid jet may be carried out by introducing a lance capable of forming jets of liquid inside the barrel of the steam generator, through an inspection hole passing through the outer barrel and the bundle wrapper of the steam generator.

In particular, it has been proposed to introduce a lance for cleaning the tube plate of the bundle of the steam generator into the central tube lane of the bundle of the generator, through openings in the barrel of the steam generator, known as handholes, situated in alignment with the central tube lane of the bundle.

In order to improve the cleaning of the tube plate, it has been proposed to introduce through the handholes into the central tube lane of the bundle of the steam generator, a cleaning assembly including in particular a cleaning boom supplied with pressurized water and including a nozzle holder mounted so that it can pivot about an axis parallel to the central tube lane and to the tube plate and bearing a set of nozzles capable of cleaning the tube plate along several alleys between the lines of tubes perpendicular to the central tube lane of the steam generator. The pivoting of the nozzles about an axis parallel to the tube plate and to the central tube lane of the steam generator allows the alleys of the tube plate between the tubes to be swept from a central region of the tube plate corresponding to the central tube lane and at least one peripheral region of the tube plate outside the bundle wrapper, in which region the sludge detached by the jets of high-pressure water sent along the tube plate from the central tube lane are collected.

In French Patent 94-10008, filed by the company FRAMATOME, there is described a cleaning device making it possible simultaneously to clean several alleys between the lines of tubes, using a lance borne by a rail fixed in the central tube lane and including a nozzle holder mounted so that it can pivot on a mobile support which can move along the rail in the central tube lane. To ensure that the various nozzle, of the nozzle holder are brought into exact alignment with a set of alleys between the tubes of the steam generators, the device additionally includes means for accurately positioning the support and the nozzle holder, these means interacting with one tube of the bundle, in each of the working positions of the support and of the nozzle holder in the direction of the central tube lane of the steam generator.

The rail and the support of the nozzle holder of the cleaning device may be inserted into the central tube lane through openings passing through the outer barrel and the bundle wrapper of the steam generator in the extension of the central tube lane of the steam generator, known as handholes.

The methods and devices for cleaning the tube plate of a steam generator from the central tube lane make it possible to sweep a set of alleys of the tube plate, each of which is situated between two flat rows of tubes and emerges in the central tube lane. These methods and devices do not, however, allow perfect cleaning of the tube plate to be achieved, owing to the fact that the spaces between the tubes of the flat rows delimiting the alleys cannot be reached by the jets of pressurized water for cleaning; the deposits situated in these spaces are generally not detached effectively by the water jets in the adjacent alleys.

It has therefore been proposed, particularly in FR-A-2,514,108 filed by the company FRAMATOME and the company STMI (Société de Travaux en Milieux Ionisants), to carry out the cleaning using not only a lance inserted into the central tube lane of the steam generator but also a lance inserted right inside the bundle between two flat rows of tubes of the bundle which are bent into a U, so as to reach those parts of the tube plate which correspond to the spaces between the lines of tubes emerging in the space between the two flat rows of tubes inside which the cleaning lance is inserted. For this purpose, use is made of a flexible cleaning lance having a substantially rectangular cross-section and a width which is smaller than the width of the space between the rows of tubes of the bundle which is inserted inside the bundle, between two rows of tubes, through one of the openings passing through the outer barrel of the bundle of the steam generator, below the lower end of the bundle wrapper, these openings being known as eyeholes. The eyeholes, which have a diameter of the order of 50 mm, allow access to be had to one or more spaces between the rows of tubes, using a flexible lance whose thickness is less than the width of the space between two rows of tubes of the bundle, this width being of the order of 10 mm.

In FR-A-2,514,108, several lances are used in succession, these lances having fixed nozzles, the inclination of which allows a point of the tube plate which is situated between two lines of tubes and a certain distance from the region of the tube plate situated vertically in line with the space separating the two rows of tubes between which the cleaning lance is inserted to be reached. By using, in succession, lances which allow points an increasing distance away from the central part of the bundle of the steam generator to be reached, it is possible to push the sludge back towards the periphery of the steam generator. However, the cleaning operation which requires the use of several lances in succession inside the bundle is a lengthy operation to carry out, owing to the large number of tubes in the bundle of the steam generator.

Furthermore, the lance allows just a single space between two lines of tubes to be cleaned, which not only increases the duration of the cleaning operation but also does not allow the spaces between the tubes to be cleaned completely because these spaces are not acted upon simultaneously by adjacent water jets.

The arrangement of the tubes of the bundle of a steam generator is defined by the shape of the lattice of holes passing through the tube plate or alternatively of the lattices of holes passing through the spacer plates distributed along the length of the straight legs of the tubes of the bundle of the steam generator. A lattice commonly used in steam generators has square meshes, the openings taking the ends of the straight legs of the tubes of the bundle being aligned in two directions at 90° of the tube plate of the steam generator. One of these directions corresponds to the direction of the central tube lane of the steam generator and the other direction at 90° corresponds to the direction of the flat rows of tubes bent into a U and of the spaces between the flat rows. In this case, by introducing a cleaning lance into the central tube lane of the steam generator, through the handholes passing through the outer barrel and the bundle wrapper of the steam generator, it is possible to clean each of the alleys of the tube plate which are situated between two successive flat rows of tubes bent into a U, it being possible for this cleaning to be achieved preferably using a pivoting nozzle holder equipped with several nozzles which are capable simultaneously of cleaning several adjacent alleys. However, the spaces of the tube plate which are situated between the tubes of the flat rows can be reached only via a lance inserted between two successive flat rows of tubes, through an eyehole of the steam generator. The cleaning using the lance inserted through an eyehole is then carried out in directions parallel to the central tube lane of the steam generator.

It has become clear that by using a single lance equipped with a fixed nozzle inserted into the bundle between two rows of tubes it is not possible to achieve effective cleaning, because of the insufficient sweep and the reduced capabilities of the lance as regards the total flow rate of cleaning water sent between the rows of tubes.

The object of the invention is therefore to propose a method for cleaning, by liquid jet, a tube plate of a heat exchanger comprising a substantially cylindrical outer barrel, a transverse tube plate integral with the outer barrel and a bundle of tubes which are bent into a U, the ends of which are fixed into holes passing through the tube plate, arranged in a plurality of parallel flat rows, each row containing a set of juxtaposed tubes bent into a U, this cleaning method making it possible to eliminate effectively any deposits situated between the tubes constituting the flat rows of the bundle of tubes and to supplement the action of cleaning the alleys of the tube plate between the rows of tubes which is carried out from the central tube lane of the bundle of the steam generator.

To this end, at least two pivoting jets of cleaning liquid, each directed between two successive lines of tubes substantially perpendicular to the rows of tubes, are sent in succession from locations situated inside the bundle, into a space between two successive rows of tubes so as to sweep the tube plate between a central part vertically in line with the space between the two rows of tubes and at least one outer part situated at the periphery of the bundle and along the length of the space between the rows of tubes with a total flow rate of cleaning liquid of at least 20 l/min per jet.

The invention also relates to a device for cleaning, by liquid jets, a tube plate of a heat exchanger comprising a substantially cylindrical outer barrel, a transverse tube plate integral with the outer barrel, a bundle of tubes, the ends of which are fixed into holes passing through the tube plate between an inlet face constituting one wall of a water box and an outlet face where the tubes of the bundle emerge, the tubes being bent into a hairpin shape and including mutually parallel straight legs arranged in parallel flat rows and in an even lattice in transverse planes parallel to the faces of the tube plate, at least one opening passing through the outer barrel in alignment with at least one space between two successive rows of tubes, the cleaning device including an at least partially flexible lance having a thickness which is less than the width of the space between two rows of tubes of the bundle and comprising means for forming at least one jet of liquid in a plane substantially perpendicular to the rows of tubes, when the lance is inserted between two rows of tubes through the opening in the outer barrel, in which the means for forming liquid jets belonging to the lance include at least two liquid-jet-forming nozzles mounted so that they can rotate on the lance about an axis parallel to the rows of tubes and to the tube plate.

In order to make the invention easy to understand, there will now be described, by way of non-limiting example, with reference to the appended figures, the implementation of the method according to the invention in a steam generator of a pressurized-water nuclear reactor, using a cleaning device including a flexible lance inserted through an eyehole of the steam generator.

Figure 1:
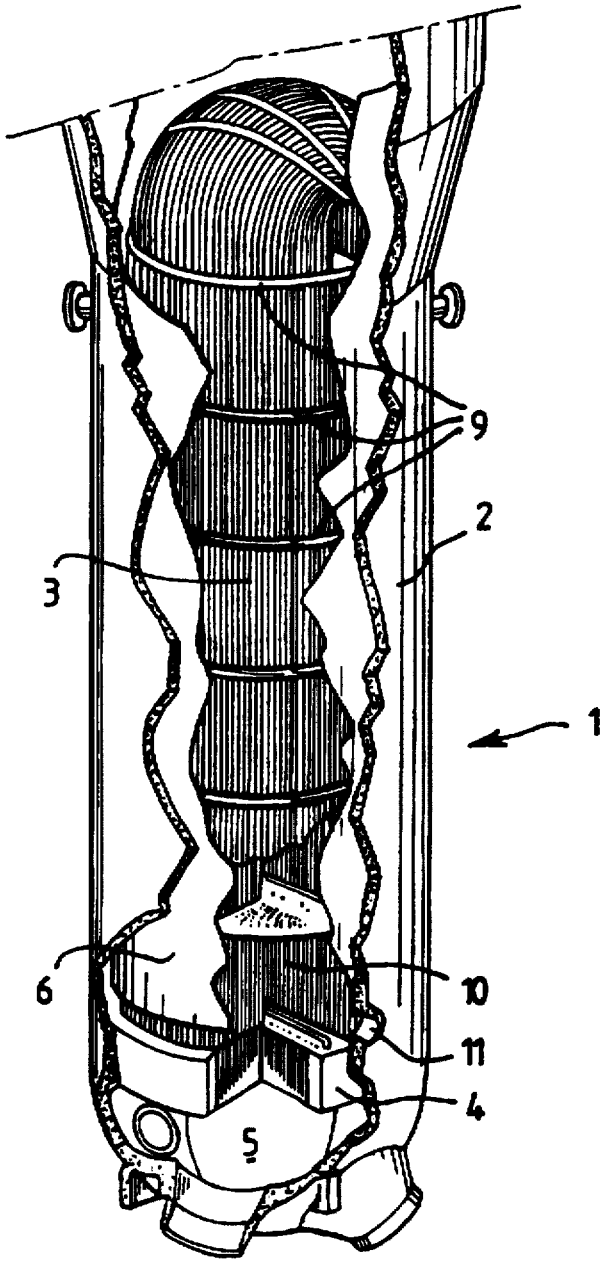
FIG. 1 is an exploded perspective view of a steam generator of a pressurized-water nuclear reactor.

In FIG. 1, the lower part of a steam generator of a pressurized-water nuclear reactor denoted as a whole by the reference 1 may be seen.

The outer barrel 2 of the steam generator of cylindrical overall shape is integral, at its lower part, with the tube plate 4. The tubes of the bundle 3 of the steam generator are bent into a U and each include two straight legs which are fixed by tube expansion and welding to the openings passing through the tube plate 4. Below the tube plate 4, the cylindrical outer barrel 2 of the steam generator is connected to a hemispherical end delimiting a two-part water box 5.

Figure 3:
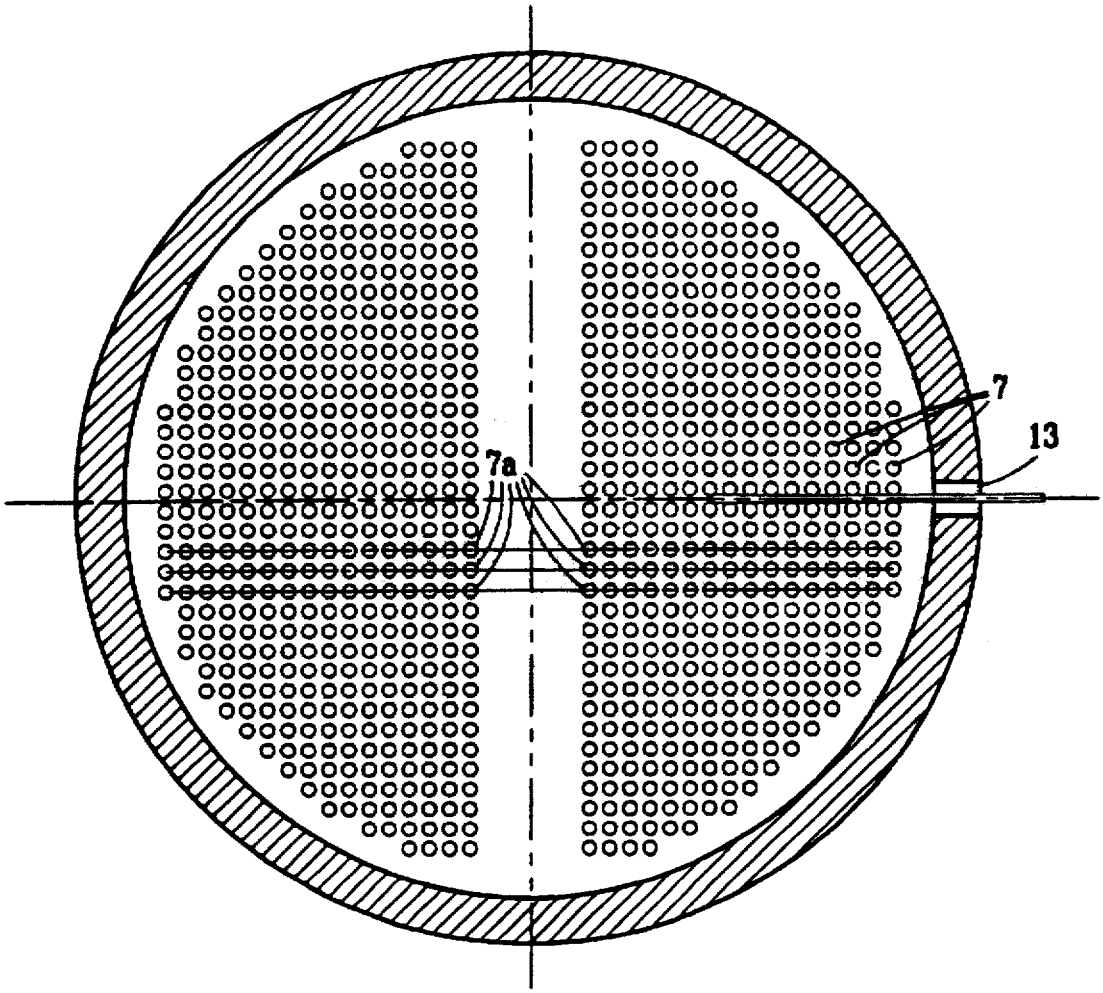
FIG. 3 is a plan view of the tube plate of the steam generator, through which plate a lattice of holes with square mesh passes.

The tube plate 4 is pierced with openings arranged in a lattice with square meshes, as will be seen in FIG. 3, over its entire surface area, with the exception of a central region of diametral direction and a peripheral region of annular shape. Each of the tubes of the bundle 3 bent into the shape of a U and including two parallel straight legs is fixed by a first straight leg into an opening situated on a first side of the central region of diametral direction of the tube plate and by its second straight leg into an opening situated on a second side of the diametral central part of the tube plate.

As may be seen in FIG. 3, the openings 7 in the tube plate which are intended to take the end parts of the straight legs of the tubes of the bundle which are arranged in a lattice with square mesh are aligned in two directions at 90°, one of the directions being parallel to the central space in the tube plate which does not have any openings, and the other direction being perpendicular to the central part without openings of the tube plate defining lines of openings 7*a*.

The ends of the straight legs of one set of tubes of the bundle, these tubes being bent into a U, are engaged and fixed in the openings of a line 7*a*, on either side of the central part of the tube plate. The tubes, the end parts of which are fixed into the holes of a line of holes 7*a*, constitute a flat row 8 of adjacent tubes, as represented in FIG. 2.

The tubes of one and the same flat row include curved upper parts, the radius of curvature of which varies from a minimum for the tube situated at the central part of the flat row, up to a maximum f or the tube situated at the outer part of the flat row. The tube situated at the central part of the flat row, which has the smallest radius of curvature of its bend, is engaged via its end parts in two holes of a line of holes 7*a* in the tube plate which are situated on either side of the central part of the tube plate. The minimum radius of curvature which can be given to the tubes of the bundle determines the separation between the straight legs of the tubes having the smallest radii of curvature (small bends) and therefore the width of the central space in the tube plate.

Figure 2:
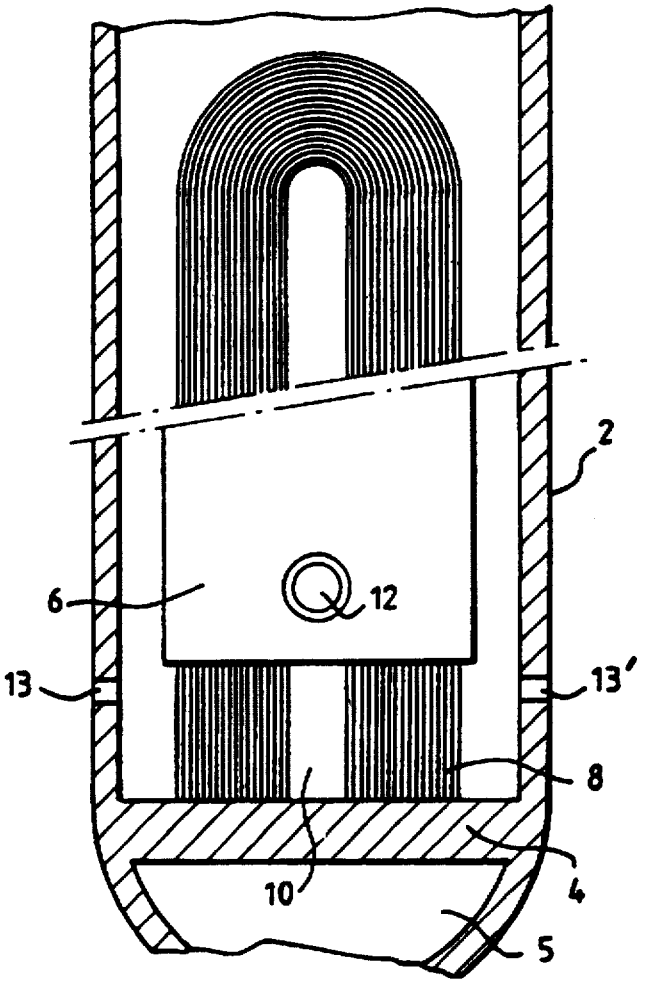
FIG. 2 is a part view of the steam generator in elevation and in section.

As may be seen in FIGS. 1 and 2, the bundle 3 at its central part delimits a free space or a tube lane 10 situated vertically in line with the central region of diametral direction of the tube plate which has no openings.

The straight legs of the tubes of the bundle are also held in transverse planes perpendicular to the axis of the bundle and of the barrel of the steam generator, in an even lattice with square mesh corresponding to the lattice of holes in the tube plate, by spacers 9 including a lattice of holes similar to the lattice of holes of the tube plate.

As may be seen in FIGS. 1 and 2, the outer barrel 2 of the steam generator and the bundle wrapper 6 have openings 11 and 12 passing through them, these openings having a coaxial arrangement and emerging in the central tube lane 10 of the bundle of the steam generator. These openings constitute the handholes of the steam generator allowing access to be had to the central tube lane. In general, the barrel of the steam generator and the bundle wrapper are pierced with sets of openings in coaxial arrangements constituting handholes, in two regions situated on one and the same diameter at the ends of the central tube lane 10.

In addition, as may be seen in FIG. 2, the outer barrel 2 of the steam generator has two openings 13, 13' passing through it, these two openings having one and the same axis parallel to the tube plate 4 and perpendicular to the axis of the handholes 12, in a region situated below the lower end of the bundle wrapper 6. The axis of the openings 13, 13', known as eyeholes, is substantially parallel to the rows of tubes 8 of the bundle of the steam generator. The eyeholes such as 13 and 13' which have a diameter of the order of 50 mm allow access to be had to the bundle 3 of the steam generator, substantially in alignment with a space between two rows of tubes of the steam generator, which rows are situated at the central part of the bundle.

In general, the tubes of the bundle have a diameter close to 20 mm and are spaced a distance of the order of 10 mm apart, so that the space between the flat rows of tubes of the bundle has a width of the order of 10 mm.

The axis of the eyeholes 13 and 13' is generally situated at a distance of the order of 250 mm above the tube plate, the lower part of the bundle wrapper 6 itself being at a height of the order of 300 mm above the tube plate and the axis of the handholes 12 at a distance of the order of 500 mm away.

In order to clean a tube plate of a steam generator bundle, it is known to insert, through a handhole 12 in the barrels of the steam generator, a cleaning lance preferably including a nozzle holder which can pivot in the direction of the axis of the handholes, so as to be able to sweep the alleys in the tube plate which are situated between the flat rows of tubes and are perpendicular to the central tube lane 10, between a point situated vertically in line with the lance in the central tube lane and at least one point situated at the periphery of the bundle, close to the annular tube lane constituting the bottom of the annular space between the bundle wrapper 6 and the outer barrel 2 of the steam generator. Thus, using high-pressure jets (several hundreds of bar), deposits which have become fixed to the tube plate are detached and entrained towards the peripheral annular tube lane where these deposits can be removed, for example by being sucked out. The known cleaning method using a lance inserted in the tube lane of the steam generator makes it possible to remove the deposits in each of the alleys of the tube plate which lie between two flat rows of tubes. By contrast, the known method does not allow the removal of the deposits between the successive tubes of a flat row, that is to say the deposits situated in those regions of the tube plate between the successive holes 7 of the lines of holes **7*a***.

The method and device according to the invention have made it possible to carry out such cleaning in an optimum manner.

Figure 4:
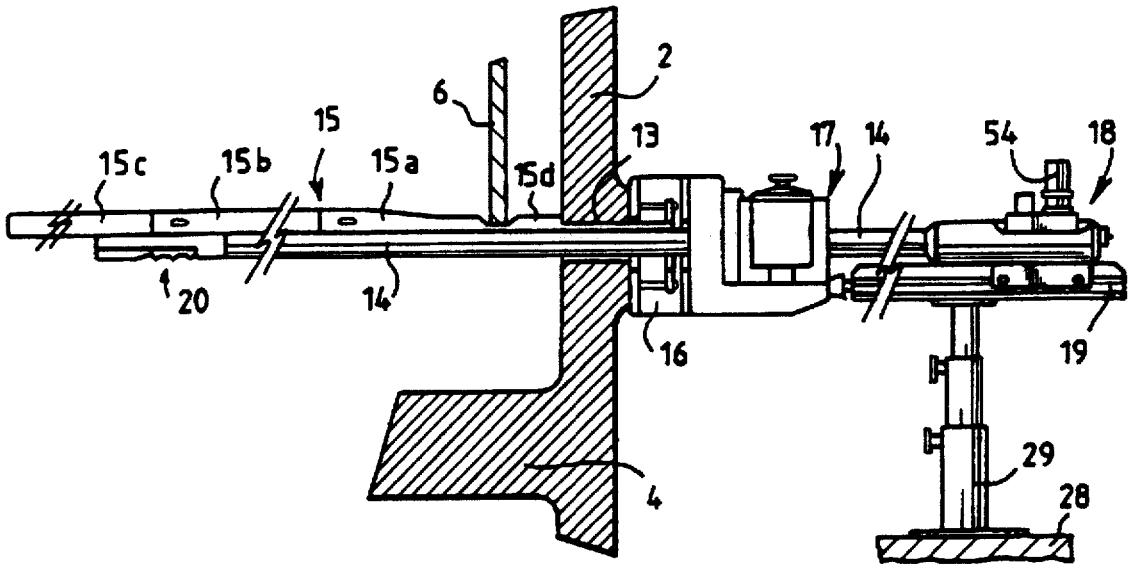
FIG. 4 is a view, in elevation and in section, of a cleaning device making it possible to implement the method according to the invention.

FIG. 4 diagrammatically represents a cleaning device which may be used to implement the method according to the invention.

The outer barrel 2 of the steam generator integral with the tube plate 4 has an eyehole 13 passing through it in a position situated slightly above the tube plate 4.

The device according to the invention mainly includes a cleaning lance 14, a lance support 15 inserted inside the bundle of the steam generator through the eyehole 13 and including an assembly 16 for fixing to the barrel of the steam generator at the eyehole 13, a device 17 for moving the cleaning lance 14 in translation, and an assembly 18 for supporting and guiding one end of the lance 14 which remains outside the barrel of the steam generator, mobile along a rail 19; the assembly 18 additionally includes means for rotationally driving a nozzle holder 20 mounted so that it can rotate about an axis parallel to the tube plate 4 on an end part of the lance inserted inside the bundle of the steam generator.

The cleaning lance 14 which is inserted inside the bundle of the steam generator between two flat rows of tubes has to be moved in terms of translation in the longitudinal direction of the space between the rows of tubes, so that the nozzles of the nozzle holder 20 can successively sweep each of the spaces of the tube plate which are arranged between two successive lines of tubes of the bundle and are perpendicular to the flat rows of tubes between which the lance 14 is inserted. For this reason, it may be necessary to move the lance over a length corresponding to the inside diameter of the barrel of the steam generator, that is to say over a distance which may be of the order of 4 metres.

It is just as possible to use simultaneously two lances inserted through the eyeholes 13 and 13' respectively.

Because the steam generators of pressurized-water nuclear reactors are arranged inside concrete bunkers, the empty space available outside the steam generators in line with the eyehole 13 is generally short.

Figure 5:
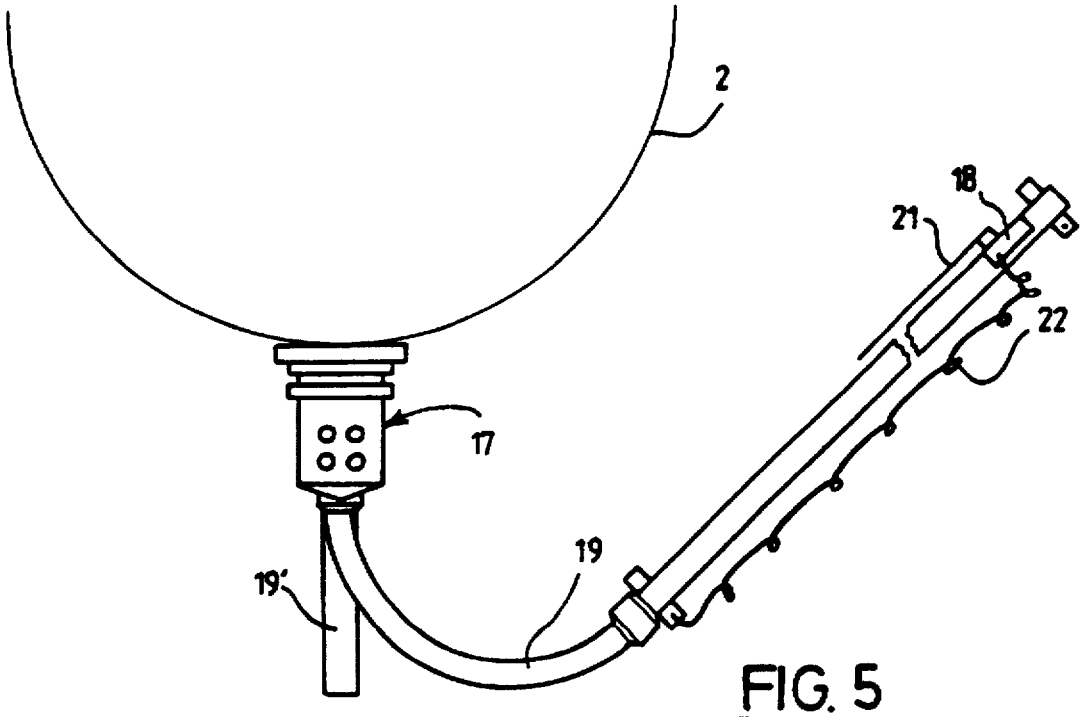
FIG. 5 is a diagrammatic view from above of the means for guiding and moving a flexible lance of the device represented in FIG. 4.

As may be seen in FIG. 5, it may be necessary to use a curved rail 19 to support the assembly 18 for guiding the end of the lance 14. The guiding assembly 18 which moves along the rail 19 is connected to at least one pipeline 21 for supplying the lance with a pressurized liquid and to an electric power lead 22, so as to power the motor for rotationally driving the assembly 18.

The assembly 17 for driving the lance 14 in terms of translation includes pairs of opposing driving rollers which engage with the lance 14. The device 17 is placed in the extension of the device 16 for fixing the support and stiffening assembly 15.

In some cases, there is enough space in the extension of the axis of the eyehole of the steam generator to use a straight rail 19'.

Figure 6:
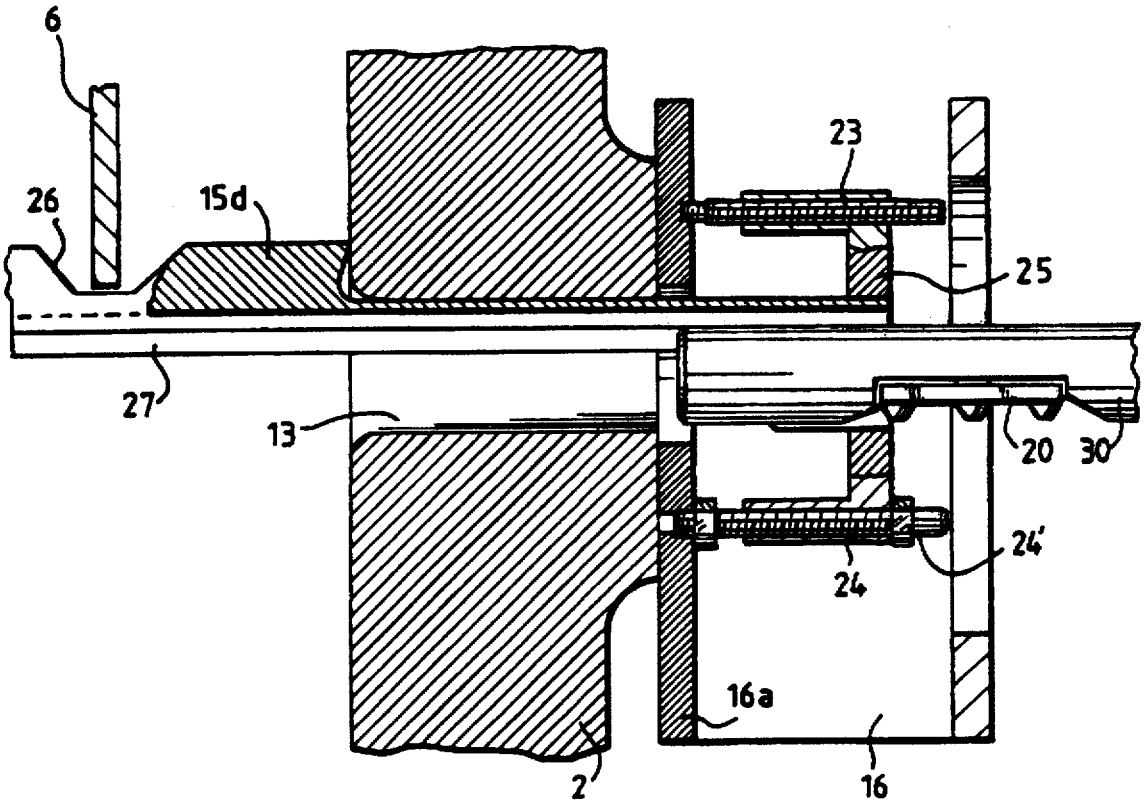
FIG. 6 is a view in section through a vertical plane of means for fixing a device for guiding a lance at an eyehole of a steam generator.

As may be seen in FIG. 6, the end of the support 15 of the lance 14 is fixed to the entry of the eyehole 13, against the outside surface of the barrel 2 of the steam generator, via the fixing device 16 including a plate **16*a* which comes to bear against the outside periphery of the eyehole 13 and is pierced with an opening for accessing the eyehole as well as clamping screws such as 23 and binding screws such as 24 engaged with gear 25 integral with the end part of the support 15. The support 15 which has a thickness smaller than the width of the space between two rows of tubes is inserted through the eyehole 13 inside the bundle of the steam generator between two rows of tubes, below the lower end of the bundle wrapper 6. As will be explained later, the support 15 consists of successive elements such as 15a, 15*b*, 15*c* (FIG. 4) which are joined together in the longitudinal extension of one another to form a support of the desired length allowing the lance 14** to be supported and guided over a path corresponding, for example, to the radius or to the diameter of the bundle.

When the support 15 is fully engaged inside the barrel 2 of the steam generator, it is positioned in an arrangement substantially parallel to the axis of the eyehole 13 and to the tube plate 4 so that it comes to bear against the upper edge of the eyehole. A cutout 26 delimiting an end heel 15*d* of the element 15*a* of the stiffening support engages under the lower part of the bundle wrapper 6. The heel 15*d* is thus wedged in between the bundle wrapper 6 and the inside surface of the outer barrel 2 of the steam generator, above the eyehole 13. The clamping screws such as 23 coming to bear against the plate 16*a* and, via it, against the outside surface of the outer barrel 2 of the steam generator allow the heel 15*d* to be clamped against the inside surface of the barrel 2 of the steam generator. The stiffening support 15 is thus fixed in cantilever fashion inside the barrel of the steam generator. The heel 15*d* of the stiffening support 15 is clamped using the gear 35 integral with the end of the stiffening support 15, in which the screws 23 are engaged in tapped holes. The through-bolts 24 fixed in tapped openings in the bearing plate 16*a* allow the gear 35 to be guided and held fast.

When the stiffening support 15 has been fixed, it is locked in place by screwing nuts 24' onto the end of the through-bolts 24. The screws 23 block the stiffening support 15 in its position of use.

The stiffening support 15 at its lower part and along its entire length includes a fastening rail 27 onto which a head 30 of the lance 14 in which the nozzle holder 20 is mounted may be fastened through the engagement of a profiled part which complements the rail 27. The lance is thus supported and guided, by its anterior part consisting of the head 30, along the length of the rail 27 and of the stiffening support 15.

Instead of a cantilevered fixing of the stiffening support 15, it would be possible to envisage fixing the ends of the stiffening support 15 at the eyeholes 13 and 13' of the steam generator which are situated in diametrically opposite positions.

As may be seen in FIG. 4, the rail 19 for guiding the cleaning lance 14, via the guide assembly 18, rests on a solid concrete block 28 of the steam generator bunker, via adjustable telescopic feet such as the foot 29. The heightwise position of the rail 19 can thus be adjusted accurately.

Figure 7:
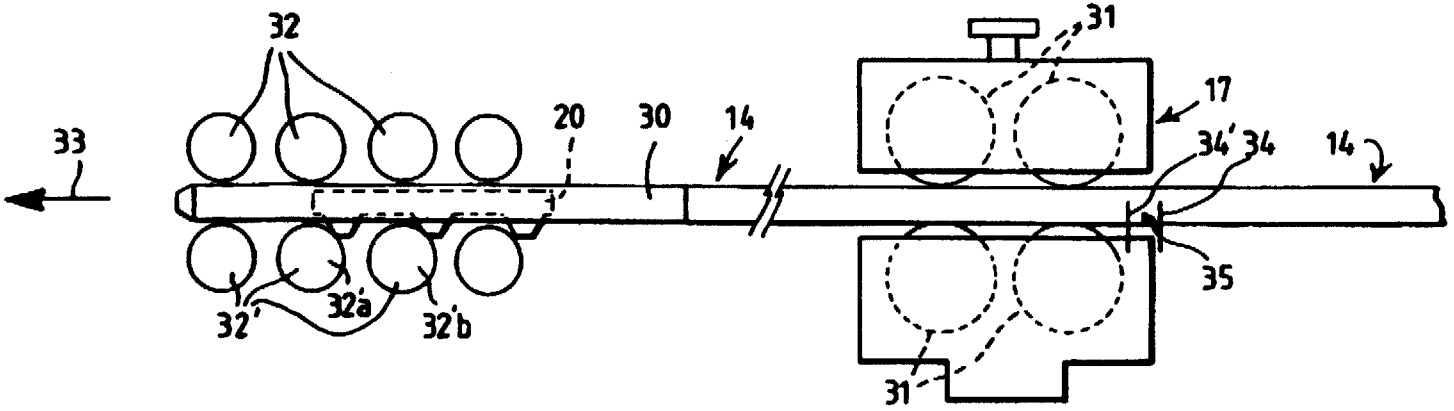
FIG. 7 is a diagrammatic view from above of the means for moving and positioning the flexible cleaning lance.

FIG. 7 represents the cleaning lance 14 which includes an anterior end consisting of the head 30 in which the nozzle holder 20 is mounted. The head 30 of the lance 14 is a rigid metal component to which one end of the lance body 14 which is made of a flexible material such as moulded plastic is fixed. The head 30 and the body of the lance have a width which is less than the width of the free space between two flat rows of tubes of the bundle.

In FIG. 7, the head 30 of the lance 14 in which the nozzle holder 20 is mounted has been represented in position inside a space between two rows of tubes 32, 32' of the bundle of the steam generator. The body of the lance 14 is engaged between two sets of motorized rollers 31 of the translational-drive assembly 17 allowing the lance 14 to be moved in the longitudinal direction of the space between the rows of tubes, as represented diagrammatically by the arrow 33. The rollers 31, the separation of which may be adjusted, come into frictional contact with the flat lateral faces of the body of the lance 14.

Before commencing an operation of cleaning the tube plate of the steam generator, the position of the nozzles of the nozzle holder 20 is adjusted. The head 30 is engaged through the eyehole 13 inside the inlet part of the bundle of the steam generator between the rows of tubes 32 and 32' as represented in FIG. 7. The nozzle holder 20 mounted so that it can move in terms of rotation on the head 30 about an axis parallel to the tube plate in the longitudinal direction of the space between the flat rows of tubes is placed in a raised position in which the nozzles of the nozzle holder project slightly into the spaces formed between the tubes 32' of one of the rows of tubes.

The head 30 is placed in a first position in which the anterior nozzle of the nozzle holder 20 comes to abut against a first tube 32'*a* of the set of tubes 32' of one of the flat rows, in order to mark a first reference point 34 on the lance body 14, at an entry face of the drive assembly 17 with motorized rollers 31. The lance is then retracted to make the first nozzle of the nozzle holder 20 abut against a second tube 32'*b* of the row of tubes 32' next to the tube 32'*a*. A second reference point 34'0 is marked on the lance body 14, opposite the entry face of the drive assembly 17. From these, the position is deduced of a reference 35 on the lance body 14 corresponding to the position of the first nozzle of the nozzle holder 20 in a transverse plane perpendicular to the longitudinal direction 33 of the space between the flat rows of tubes, equidistant from the tubes 32'*a* and 32'*b*. Thus a position of the lance and of the lance head 30 is defined such that the jet from the anterior nozzle of the nozzle holder is directed along the axis of the space between two lines of tubes perpendicular to the flat rows of tubes 32 and 32'.

The spacing of the nozzles of the nozzle holder 20 corresponds to the exact spacing of the tubes of the bundle defined by the square mesh lattice of the tube plate.

In order to adjust the position of the head of the lance and of the nozzle holder 20 as it is moved in the space between the two flat rows of tubes 32 and 32', the same adjustment is carried out for neighbouring tubes of the row of tubes 32 or 32' which are situated at various points spaced along the length of the space between the rows of tubes 32 and 32'.

Between the positions which are predefined and marked on the lance body 14, the lance and the head 30 on which the nozzle holder 20 is mounted are moved step by step, each of the steps of movement corresponding to a multiple of the distance between two tubes of the bundle. Thus the tube plate is cleaned successively in alleys, each of which is situated between two lines of tubes perpendicular to the flat rows between which the cleaning lance is inserted.

Figure 9:
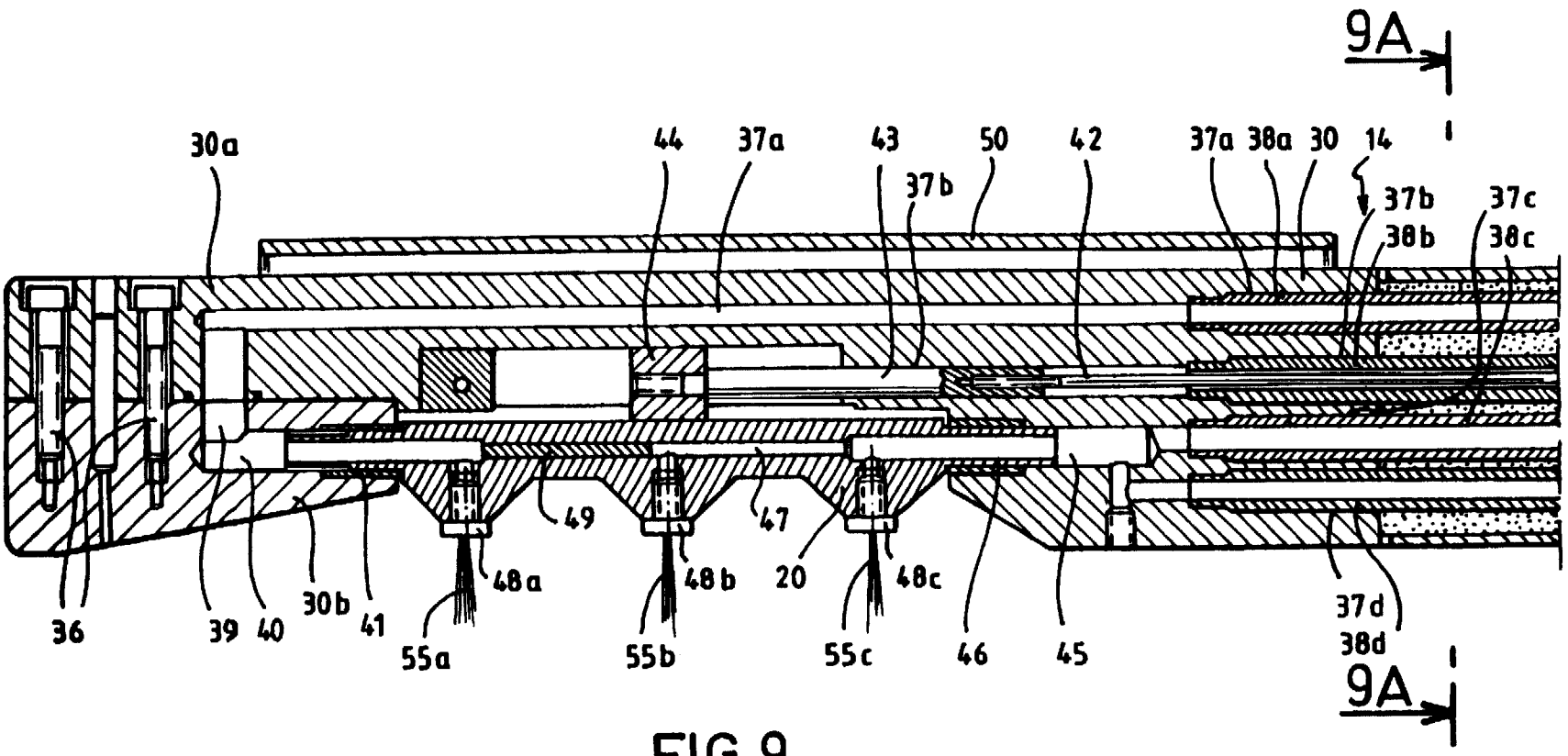
FIG. 9 is a sectional view of an end part of the lance of a cleaning device according to the invention including a pivoting nozzle holder.
Figure 9A:
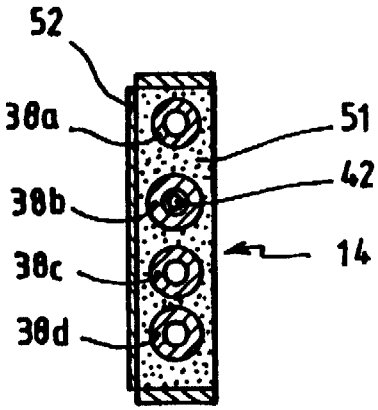
FIG. 9A is a view in section on AA of FIG. 9.
Figure 11:
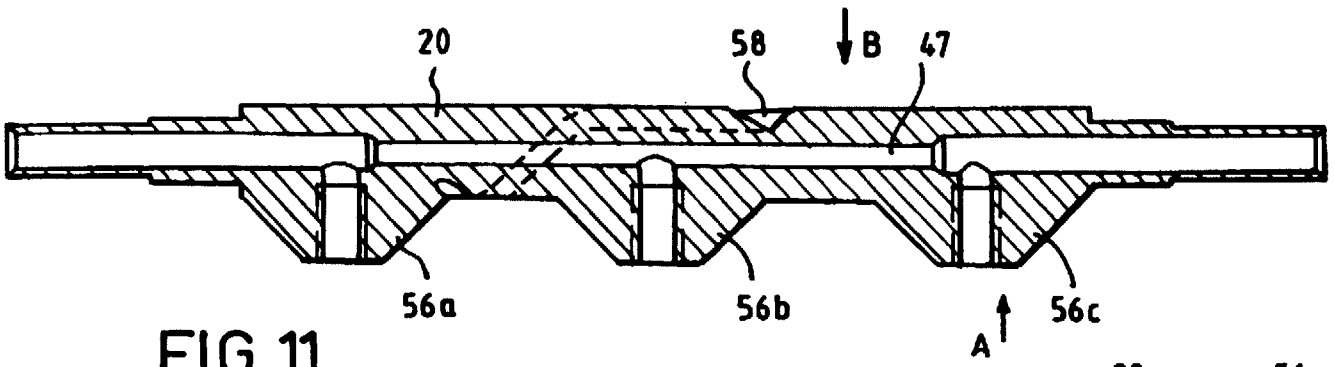
FIG. 11 is a view in axial section of the nozzle holder of the lance of the cleaning device.
Figure 11A:
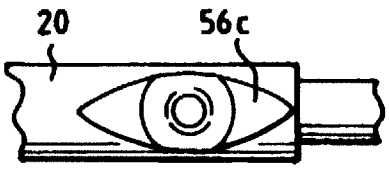
FIG. 11A is a view on A of FIG. 11.
Figure 11B:
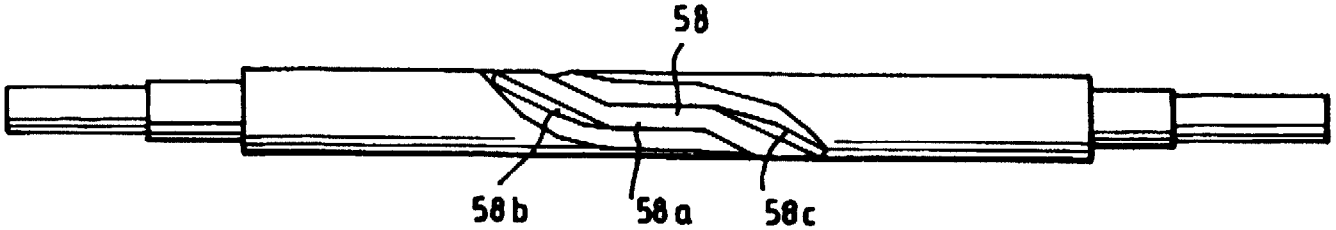
FIG. 11B is a rear view of the nozzle holder on B of FIG. 11.

FIG. 9 represents the head 30 of a cleaning lance 14 on which the nozzle holder 20, which will be described in more detail with reference to FIGS. 11, 11A and 11B, is mounted such that it can pivot.

The head 30 of the lance 14 is made by joining together two metal components 30*a* and 30*b*, using screws 36.

The component 30*a* has a rectangular transverse section, the shape and size of which are identical to the shape and size of the cross-section of the lance body 14 represented in FIG 10A. The width of this cross-section is less than the width of the space between two flat rows of tubes of the bundle of the steam generator.

The component 30*b* attached and fixed by screws 36 against the component 30*a* also has a thickness less than the space between two successive rows of tubes.

The component 30*a* is machined to exhibit four substantially parallel internal ducts 37*a*, 37*b*, 37*c* and 37*d* of longitudinal direction, the inlet part of which is widened diametrally, to take the end of a respective pipe 38*a*, 38*b*, 38*c*, 38*d* which is inserted inside the inlet part of the corresponding duct 37*a*, 37*b*, 37*c*, 37*d* of the component 30*a*.

The duct 37*a* is machined in the longitudinal direction of the component 30*a* up to near its anterior part to which the component 30*b* is fixed. The anterior end of the duct 37*a* is connected via a transverse opening 39 to a duct 40 of longitudinal direction machined in the form of a blind hole inside the component 30*b*. Inserted inside the widened-diameter inlet part of the duct 40 is a bearing 41 in which one end of the nozzle holder 20, made in the form of a hollow journal, is mounted such that it can rotate.

The duct 37*b* emerges in a groove in the component 30*a*, behind the nozzle holder 20, that is to say on the opposite side of the nozzle holder to the nozzle outlet.

Mounted inside the duct 38*b* accommodated in the end part of the duct 37*b*, in a manner such that it can slide, is a steel wire 42 of the piano wire type. The steel wire 42 is engaged and fixed at its anterior end inside a tubular component 43 mounted such that it can slide in the end part of the duct 37*b* and integral at its end with a component 44 for actuating the nozzle holder 20.

As will be explained later, a pivoting movement is transmitted to the nozzle holder 20 via the steel wire 42, the sliding component 43 and the actuating component 44 which acts like a cam.

The ducts 37*c* and 37*d* are placed in communication, at their anterior end part, with a duct 45 which emerges in a groove in the component 30*a*, in the axial extension of the duct 40.

A bearing 46 is mounted inside the inlet part of the duct 45. The second end of the nozzle holder 20, the end opposite its end engaged in the bearing 41 and made is in the form of a hollow journal, is engaged such that it can rotate inside the bearing 46.

Passing right along the length of the nozzle holder 20 is a duct 47 connecting the two hollow end journals. The three nozzles 48*a*, 48*b* and 48*c* fixed to the nozzle holder 20 may be supplied with cleaning liquid via the duct 47. The duct 47 which is split into two parts by a stopper 49 is supplied with cleaning liquid either by the duct 37*a* and the pipe 38*a*, or simultaneously by the ducts 37*c* and 37*b* and the pipes 38*c* and 38*d*.

The part of the duct 47 which supplies the nozzle 48*a* is supplied with cleaning liquid by the duct 37*a* and the pipe 38*a*.

The part of the duct 47 supplying the nozzles 48*b* and 48*c* is itself supplied with cleaning liquid via the duct 45 and the pipe such as 38*a*, 38*c* and 38*d*.

In this way, each of the nozzles can receive the flow conveyed by a pipe 38*a*, 38*c* and 38*d*.

Fixed to the upper surface of the component 30*a* is a profiled element 50 intended to interact with the rail 27 of the stiffening support 15, in order to guide, support, and hold the head of the lance 14 on which the nozzle holder 20 is mounted. The support 15, in addition to its roles of supporting and guiding, has a role in stiffening the flexible lance 14, the head of which is thee held fast against the stiffening support 15. Specifically, the stiffener 15 allows the reaction force of the high-pressure cleaning jets which is transmitted to the nozzle holder 20 and the head 30 during cleaning to be absorbed.

Figure 10:
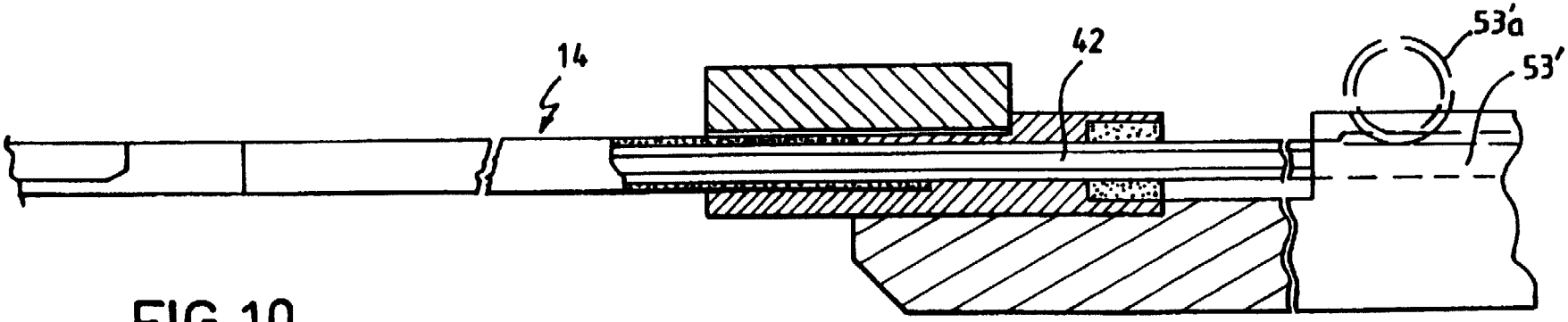
FIG. 10 is a view from above and in part section, of part of the lance of the cleaning device.

As may be seen in FIGS. 9, 10 and 10A, the pipes 38*a*, 38*b*, 38*c* and 38*d* are embedded in the lance body 14 which may be produced by overmoulding a flexible plastic over the pipes 38*a*, 38*b*, 38*c* and 38*d* placed in parallel arrangements in the longitudinal direction of the lance.

In addition, the body of the lance 14 made of flexible plastic 51 is stiffened by a thin stainless steel strip 52 0.4 mm thick which is bonded against one of the flat lateral faces of the body of the lance 14.

Represented in FIG. 10 is the opposite end of the lance body 14 to the head 30, which is fixed by screws inside the supporting structure 53 of the device 18 for guiding and rotationally driving the nozzle holder 20.

Mounted so that it can be moved in translation in the longitudinal direction in the supporting structure 53 of the drive device is a drive component 53' including a rack. The device 54 for the motorization of the drive assembly 18 includes a pinion 53' a which meshes with the rack of the component 53' to which the opposite end of the steel wire 42 to the actuating components 43 and 44 is fixed.

By means of the motorization device and of the component 53' including the driving rack, the steel wire 42 may be moved in translation in the longitudinal direction inside the pipe 37*b* with a certain amplitude in one direction or the other. Translational drive is transmitted by the wire 42 to the component 43 and to the actuating component 44 which constitutes a cam in engagement with a slot machined on the posterior part of the nozzle holder 20.

FIGS. 11, 11A and 11B represent the nozzle holder 20, the body of which has passing through it the duct 47 emerging in the end parts of the nozzle holder constituting hollow journals by means of which the duct 47 may be supplied with cleaning liquid. The nozzles 48*a*, 48*b* and 48*c* (FIG. 9) are fixed into three corresponding tapped openings machined in projecting parts 56*a*, 56*b* and 56*c* of the nozzle holder 20 having a cross-section of elongate shape visible in FIG 11A.

The distance between centres of the tapped openings accommodating the nozzles is defined very accurately and set at a value equal to the distance between centres of the tubes of the bundle of the steam generator.

As may be seen in FIG. 11 and in FIG. 11B, the rear face of the nozzle holder 20, the opposite face to the face of the nozzle holder including the projecting parts 56*a*, 56*b* and 56*c*, is machined in its central part into the form of a slot 58. The slot 58 has a central part 58*a* of longitudinal direction and two end parts 58*b* and 58*c* having the shape of helices having, as an axis, the axis of rotation of the nozzle holder 20 and a slope of 20° with respect to the axial direction of the nozzle holder.

As may be seen in FIG. 11, the slot 58 has a cross-section of substantially rectangular shape. The actuating component 44, integral via the component 43 with the steel wire 42, includes an actuating finger whose cross-section corresponds to the cross-section of the slot 58. The actuating finger of the component 44 is inserted, practically without play, into the slot 58. The component 44 is mounted such that it can slide inside the cavity of the component 30*a* of the lance head 30 so as to move in terms of longitudinal translation.

The translational movement of the component 44 caused, in one direction, by pushing, and in the other direction, by pulling on the component 43 via the steel wire 42, causes the nozzle holder to pivot between two extreme positions corresponding to an orientation of the liquid jets 55*a*, 55*b* and 55*c* produced by the nozzles which is such that the jets strike one or other of the end-parts of an alley between two lines of tubes of the bundle at the periphery of the bundle of the steam generator.

Between these two extreme positions obtained when the actuating finger of the component 44 has reached the end of the slot 58, the jets move between the peripheral ends of the alleys of the tube plate and a region situated vertically in line with the nozzle holder between the two rows of tubes, this direction of the jets perpendicular to the tube plate being obtained when the actuating finger of the component 44 is in the central part 58*a* of the slot 58.

The opposite end part of the pipes 38*a*, 38*c* and 38*d* to the head 30, at the assembly 18 for supporting, guiding, and rotational drive, is connected to a source of washing liquid at very high pressure, for example at a pressure of 300 to 400 bar.

Furthermore, the total flow rate supplied by the source and transmitted to the nozzles of the nozzle holder 20 via the pipes 38*a*, 38*c* and 38*d* can be set to a high value, insofar as each of the nozzles receives the maximum flow rate which can be sent through each of the pipes. The total flow rate received by the nozzles of the nozzle holder during cleaning is approximately 60 l/min. Highly effective cleaning is thus achieved. It has been shown that it was necessary to use a cleaning flow rate of at least 40 l/min, supplying at least two nozzles simultaneously in order to achieve effective cleaning of two adjacent alleys of the tube plate which are perpendicular to the space between two flat rows of tubes between which the cleaning lance is inserted.

Figure 8:
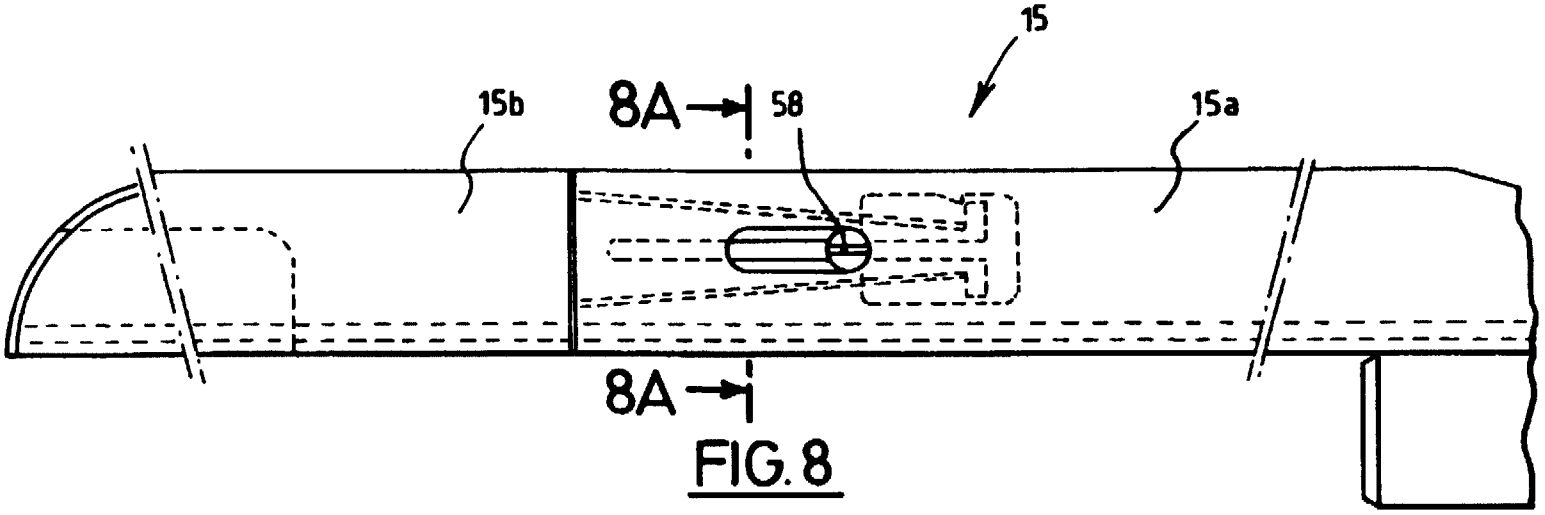
FIG. 8 is a part view in elevation of the means for guiding the cleaning lance inside the bundle of the steam generator.
Figure 8A:
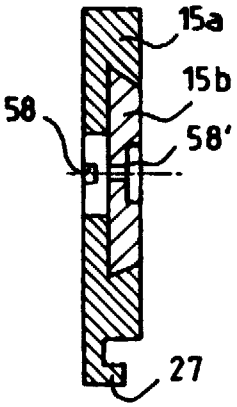
FIG. 8A is a section on A—A of FIG. 8.

FIGS. 8 and 8A represent two successive elements 15*a* and 15*b* of the stiffening support 15 which are joined together by two parts having a dovetail profile. These two parts can slide in the longitudinal direction with respect to one another and are joined together using a screw 58 integral at its end with a locking shank 58', the head of which is engaged in a longitudinal slot in the component 15*a* and the shank of which is engaged in a longitudinal slot in the component 15*b*. The components 15*a* and 15*b* can be moved in terms of translation with respect to each other then detached from one another after having rotated the screw 58 through a quarter of a turn, the relative longitudinal movement of the components 15*a* and 15*b* making it possible to disengage the two dovetail parts from one another.

Thus the stiffening support 15 can be constructed simply and quickly at the time when the stiffening support is engaged inside the steam generator, between two flat rows of tubes.

After the stiffening support 15, assembled into a structure of the desired length, has been engaged inside the steam generator, it is positioned and held fast by clamping, using the fixing device 16 as was described earlier.

The lance 14 is then fitted and inserted through the eyehole of the steam generator and fastened, via the profiled part 50 of the head 30, onto the rail 27 of the stiffening support 15. With the support rail 19 and the translational drive assembly 17 and rotational drive assembly 18 having been fitted, the position of the nozzles is adjusted as described earlier.

The nozzle holder is placed in a first position in which the jets produced by the three nozzles of the nozzle holder are directed into three adjacent spaces between the three first lines of tubes perpendicular to the two flat rows of tubes between which the lance 14 is inserted. The nozzles are supplied with pressurized cleaning liquid at a total flow rate of the order of approximately 60 l/min. The rotational drive assembly 18 is brought into operation so as to cause the nozzle holder to pivot so that the jets produced by the nozzles sweep three adjacent alleys of the tube plate along their entire length, between a position vertically in line with the space between the rows of tubes and a first peripheral end of the alleys of the tube plate and between the position vertically in line with the space between the rows of tubes and the second, outer peripheral end of the adjacent alleys of the tube plate.

The sludge detached by the pressurized cleaning liquid jets are conveyed towards the peripheral part of the bundle and sucked out from this peripheral part.

The nozzle holder is then moved using the translational drive assembly 17 through a distance corresponding to three pitches of the lattice of tubes. A complete cycle of cleaning three alleys of the tube plate of the bundle which are perpendicular to the flat rows of tubes between which the cleaning lance is inserted is resumed.

The tube plate of the steam generator is thus completely cleaned by moving the head of the cleaning lance along the entire length of the space between the two flat rows of tubes.

The method and device according to the invention therefore make it possible to achieve complete cleaning of those regions of the tube plate which were not reached in a cleaning operation of the prior art using a lance inserted into the central tube lane of the bundle.

The invention is not limited to the embodiment which has been described.

Thus, a cleaning lance in an embodiment different from the one described may be envisaged.

The nozzle holder may have a number of nozzles other than three. However, for the implementation of the invention, it is necessary to use at least two nozzles receiving a flow rate of cleaning liquid at least equal to 20 l/min per nozzle.

The means for moving the lance in translation and for driving the nozzle holder in rotation may be different from those described.

The stiffener may also assume a form different from the modular embodiment described earlier.

The invention applies to the case of all steam generators which have a bundle of tubes which are arranged in a square mesh lattice in the transverse planes of the bundle.

We claim:

1. Device for cleaning, by liquid jets, a tube plate (4) of a heat exchanger comprising a substantially cylindrical outer barrel (2), a transverse tube plate (4) integral with the outer barrel (2), a bundle (3) of tubes, the ends of which are fixed into holes (7) passing through the tube plate (4) between an inlet face constituting one wall of a water box (5) and an outlet face where the tubes of the bundle emerge, the tubes being bent into a hairpin shape and including mutually parallel straight legs arranged in parallel flat rows and in an even lattice in transverse planes parallel to the faces of the tube plate (4), at least one opening (13, 13') passing through the outer barrel in alignment with at least one space between two successive rows of tubes, the cleaning device including an at least partially flexible lance (14) having a thickness which is less than the width of the space between two rows of tubes of the bundle (3) and comprising means for forming at least one jet of liquid in a plane substantially perpendicular to the rows of tubes, when the lance (14) is inserted between two rows of tubes through the opening (13) in the outer barrel (2), characterized in that the means for forming a liquid jet (55*a*, 55*b*, 55*c*) belonging to the lance (14) include at least two liquid-jet-forming nozzles (48*a*, 48*b*, 48*c*) mounted so that they can rotate on the lance (14) about an axis parallel to the rows of tubes (32, 32') and to the tube plate (4).

2. Device according to claim 1, characterized in that the lance (14) includes a flexible lance body made of plastic and a rigid head (50) integral with one end of the lance body (14), on which a nozzle holder (20) is mounted so that it can pivot, the nozzle holder including at least two nozzles (48*a*, 48*b*, 48*c*) arranged with a spacing corresponding to the spacing of the tubes of the bundle (3).

3. Device according to claim 2, characterized in that the lance body (14) includes pipes (38*a*, 38*c*, 38*d*) for supplying the nozzles (48*a*, 48*b*, 48*c*) with cleaning liquid, having a longitudinal direction, the number of cleaning liquid supply pipes (38*a*, 38*c*, 38*d*) being equal to the number of nozzles of the nozzle holder (20).

4. Device according to claim 3, characterized in that three nozzles (48*a*, 48*b*, 48*c*) are mounted on the nozzle holder (20) and that the lance body (14) has three cleaning liquid supply pipes (38*a*, 38*c*, 38*d*).

5. Device according to claim 4, characterized in that the supply pipes (38*a*, 38*c*, 38*d*) are fixed at one of their ends to the head (30) on which the nozzle holder (20) is mounted and that the lance body (14) is constructed using flexible plastic (51) over-moulded over the supply pipes (38*a*, 38*c*, 38*d*) along their entire length.

6. Device according to either one of claim 3, characterized in that the supply pipes (38*a*, 38*c*, 38*d*) are fixed at one of their ends to the head (30) on which the nozzle holder (20) is mounted and that the lance body (14) is constructed using flexible plastic (51) overmoulded over the supply pipes (38*a*, 38*c*, 38*d*) along their entire length.

7. Device according to claim 1, characterized in that the lance body (14) includes a longitudinal pipe (38*b*) in which there is-mounted, so that it can move in terms of translation in the longitudinal tudinal direction, a steel wire (42) integral at one of its ends with an actuating component (43, 44) and interacting at its other end with means (53, 18) allowing it to be moved in terms of translation in one direction and the other with limited amplitude and that the nozzle holder (20) on a face opposite the nozzles (48*a*, 48*b*,48*c*) includes a slot (58) in which there is engaged an actuating finger of the actuating component (44), the slot (58) having parts in the form of a helix about a longitudinal axis of rotation of the nozzle holder so that the translational movement of the steel wire (42) and of the actuating component (44) causes the nozzle holder (20) to start to pivot.

8. Device according to claim 1, characterized in that it additionally includes a support (15) for stiffening the lance (14), the thickness of which is smaller than the width of a space between two flat rows of tubes and which includes means (16) for fixing inside the outer barrel (2) of the steam generator, these means being arranged level with the opening (13, 13') of the outer barrel (2) of the steam generator.

9. Device according to claim 8, characterized in that the stiffening support includes at least two elements (15*a*, 15*b*, 15*c*) which can be joined together in the longitudinal extension of one another.

* * * * *

UNITED STATES PATENT AND TRADEMARK OFFICE

CERTIFICATE OF CORRECTION

PATENT NO. : 5,782,255
DATED : July 21, 1998
INVENTOR(S) : Bernard MAGNIN et al.

It is certified that error appears in the above-identified patent and that said Letters Patent is hereby corrected as shown below:

On the title page, item
[75] Change "Alain Vouzelland" to --Alain Vouzelaud--.

Signed and Sealed this

Eighth Day of December, 1998

Bruce Lehman

*Attest:*

BRUCE LEHMAN

*Commissioner of Patents and Trademarks*

*Attesting Officer*